United States Patent [19]

Nishizaki et al.

[11] 3,971,008

[45] July 20, 1976

[54] CRANE OVERLOAD DETECTOR USING A BOOM BENDING MOMENT DETECTOR

[75] Inventors: Hiroshi Nishizaki; Kanji Yonekura, both of Tamano; Yuichi Tsuji, Tokyo, all of Japan

[73] Assignee: Mitsui Shipbuilding and Engineering Co., Ltd., Tokyo, Japan

[22] Filed: Mar. 4, 1975

[21] Appl. No.: 555,179

[30] Foreign Application Priority Data

Mar. 5, 1974 Japan ..... 49-25254

[52] U.S. Cl. ..... 340/267 C; 212/39 R; 340/272

[51] Int. Cl.[2] ..... G08B 21/00

[58] Field of Search ..... 340/267 C; 212/39 R, 212/86; 73/88.5 SD

[56] References Cited

UNITED STATES PATENTS

| | | | |
|---|---|---|---|
| 3,199,685 | 8/1965 | Bopp | 340/267 C |
| 3,638,211 | 1/1972 | Sanchez | 340/267 C |
| 3,638,212 | 1/1972 | Peter et al. | 340/267 C |
| 3,815,116 | 6/1974 | Fink | 340/267 C |

*Primary Examiner*—Glen R. Swann, III

*Attorney, Agent, or Firm*—Charles E. Pfund

[57] ABSTRACT

For a crane having a boom for hanging loads apparatus for detecting overload is provided which comprises a boom bending moment set value generator, which is determined by a variable quantity corresponding to the operating radius of the crane, a boom bending moment detector having transversely spaced strain gauges mounted on the boom, a comparator for comparing the output of the boom bending moment set value generator with the averaged output of the boom bending moment detector, and means operated by the output of the comparator which is produced when the output of the detector exceeds the output of the boom bending moment set value generator.

10 Claims, 6 Drawing Figures

CRANE OVERLOAD DETECTOR USING A BOOM BENDING MOMENT DETECTOR

BACKGROUND OF THE INVENTION

This invention relates to apparatus for detecting overload of a crane.

When an overload is applied to a crane there occurs such troubles as turn over of the crane, breakage of the boom and damage of the goods lifted by the crane. Accordingly, it is important for the crane operator to know the overload condition.

The factors that cause overloading of a crane are the weight of the goods lifted by the crane and the operating radius. However, there is no suitable location at which the weight of the goods can be detected. Even when the weight is detected its measured value has been extremely inaccurate so that if such detected value were used as a parameter for the apparatus for preventing overload, the accuracy of the apparatus would be extremely low.

According to one method of detecting the weight of a lifted load, a load cell is used to measure directly the weight. However, the range of the weight that can be measured by this method is not so wide. Since the weight of the load handled by a crane generally varies over a wide range of from 300 kg to 30 tons it is impossible to measure the weight at high accuracies. Further, where a load cell is used, unless the position on the crane at which the load cell is to be mounted is precisely selected, the detected value would contain an erroneous component.

According to another method, the tension of a rope for supporting the load is utilized to measure the weight of the load. With this method the sheave efficiency of the pulley affects directly the measured value thus causing it to be inaccurate. Although many other methods of measuring the weight of the load have been proposed, the accuracy of the measurement is decreased due to frictions of the pulley, pins, oil pressure packings or the like which are difficult to estimate.

SUMMARY OF THE INVENTION

Accordingly, it is the object of this invention to provide improved apparatus for detecting an overload condition of a crane which can greatly improve the accuracy of measuring the weight of the load thereby stabilizing the measuring operation during overload.

According to this invention there is provided apparatus for detecting overload of a crane having a boom for lifting loads, comprising a boom bending moment set value generator, which is determined by a variable quantity corresponding to the operating radius of the crane, a boom bending moment detector mounted on the boom, a comparator for comparing the output of the boom bending moment set value generator with the output of the boom bending moment detector, and means operated by the output of the comparator which is produced when the output of the detector exceeds the output of the boom bending moment set value generator.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
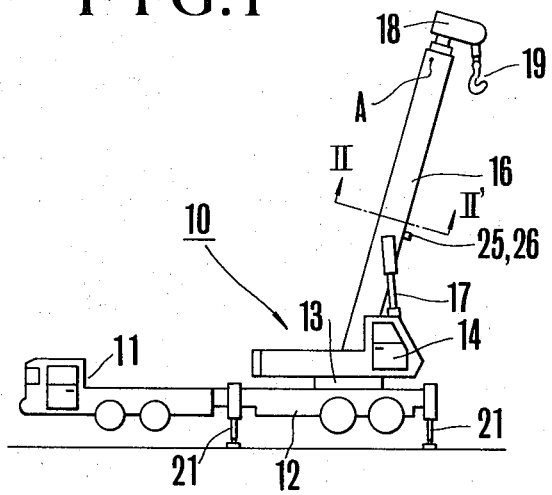
FIG. 1 is a diagrammatic side view of a crane to which the invention is applicable.
Figure 2:
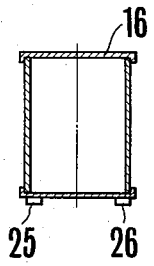
FIG. 2 is a cross-sectional view of the boom shown in FIG. 1 taken along a line II-II with internal components omitted.

FIG. 1 shows a side view of a crane, more particularly a truck crane for example to which the invention is applicable. The crane 10 shown therein is mounted on the platform 12 of a truck 11 and is provided with a turret 13 rotatably supported on the platform 12. Although not shown in the drawing an internal combustion engine or other prime mover for driving the crane is housed in the turret 13 and a cabin including an operator's seat 14 is mounted on the turret 13. A boom 16 which can move in the vertical and horizontal directions is mounted on a pivot pin (not shown) secured to the upper surface of the turret. The boom 16 is moved in the horizontal direction by a swinging mechanism (not shown) mounted on the turret 13 and in the vertical direction by an oil pressure cylinder 17, as is well known in the art. The cross-sectional configuration of the boom 16 is a hollow rectangle as shown in FIG. 2. A plurality (in this example 3) of boom segments of similar configuration are telescoped in the boom 16 for varying the length of the boom. A pulley block 18 of the well known construction is secured on the outer end of the boom to hang a hook 19 through a wire rope not shown. A plurality of outriggers 21 are provided for the platform 12 for stabilizing the same while the crane is operating. The construction of the crane thus far described is well known and various component elements which are not necessary to the understanding of the invention are omitted.

Figure 3:
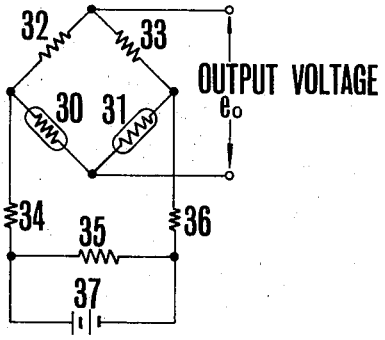
FIG. 3 shows a circuit diagram of a detector for measuring the boom bending moment of the crane shown in FIG. 1.

Boom bending moment detectors 25 and 26 which constitute a portion of the novel apparatus for detecting the overload of the crane are mounted on the boom 16 as diagrammatically shown in FIGS. 1 and 2. More particularly, the detectors 25 and 26 are mounted on the lower surface of the boom at positions symmetrical to the plane including the longitudinal axis of the boom and at suitable positions along the length of the boom. In this example, the detectors 25 and 26 are mounted on the boom at a position where the upper end of the oil pressure cylinder 17 for moving the boom in the vertical direction is connected to the boom, and at which the strain or the boom bending moment is maximum. However, the detectors need not necessarily be mounted on this position. So long as the detectors are mounted on any point between this point and the upper end of the boom it is possible to detect a strain proportional to the boom bending moment. As the detectors may be used strain gauges of a known construction. FIG. 3 illustrates one example of the construction of the detector 25 which comprises a pair of strain gauges 30 and 31 which are connected in a resistance bridge circuit together with resistors 32 and 33. The input terminals of the bridge circuit are connected across a source 37 shown as a battery through resistors 34 and 36. A resistor 35 is also connected across the source 37. The bridge circuit is adjusted to produce a zero output voltage $e_0$ under no load condition but produces an output voltage when a strain is created in the boom 16. The detector 26 has the same construction. Since the detectors 25 and 26 or the strain gauges 30 and 31 are mounted on the lower surface of the boom 16 they are subjected to compressive strains. Although not shown in FIG. 1, a detector 28 for detecting the variable quantities corresponding to the operation radius of the crane is mounted near the pivot pin of the boom. The purpose of this detector is to detect the angle of inclination of the boom with respect to the ground surface or the angle of swinging of the turret 13. The angle of inclination can be measured by mounting a pendulum on the shaft of a potentiometer resistor for changing the inclination angle of the boom into resistance variation. This detector can be mounted on the boom near the point at which the oil pressure cylinder 17 is connected to the boom. The swinging angle of the turret can be measured by connecting the shaft of a potentiometer resistor to the pivot pin of the boom for converting the horizontal swinging angle of the boom into resistance variation. In this example, the latter detector, that is the detector which detects the swinging angle of the turret is preferred because less quantity of noise is superposed upon the detected value. Further, a boom length detector 29 is mounted on the boom at point A, for example, shown in FIG. 1. This detector is constructed such that one end of a wire wound about a reel is fixed to the upper end of the boom 16 so that the extended or contracted length of the boom is expressed by the length of the wire that has been paid out from the reel and that the number of revolutions of the reel is transmitted to the shaft of a potentiometer resistor through a reduction gearing thereby transforming the variation in the length of the boom into resistance variation.

Figure 4:
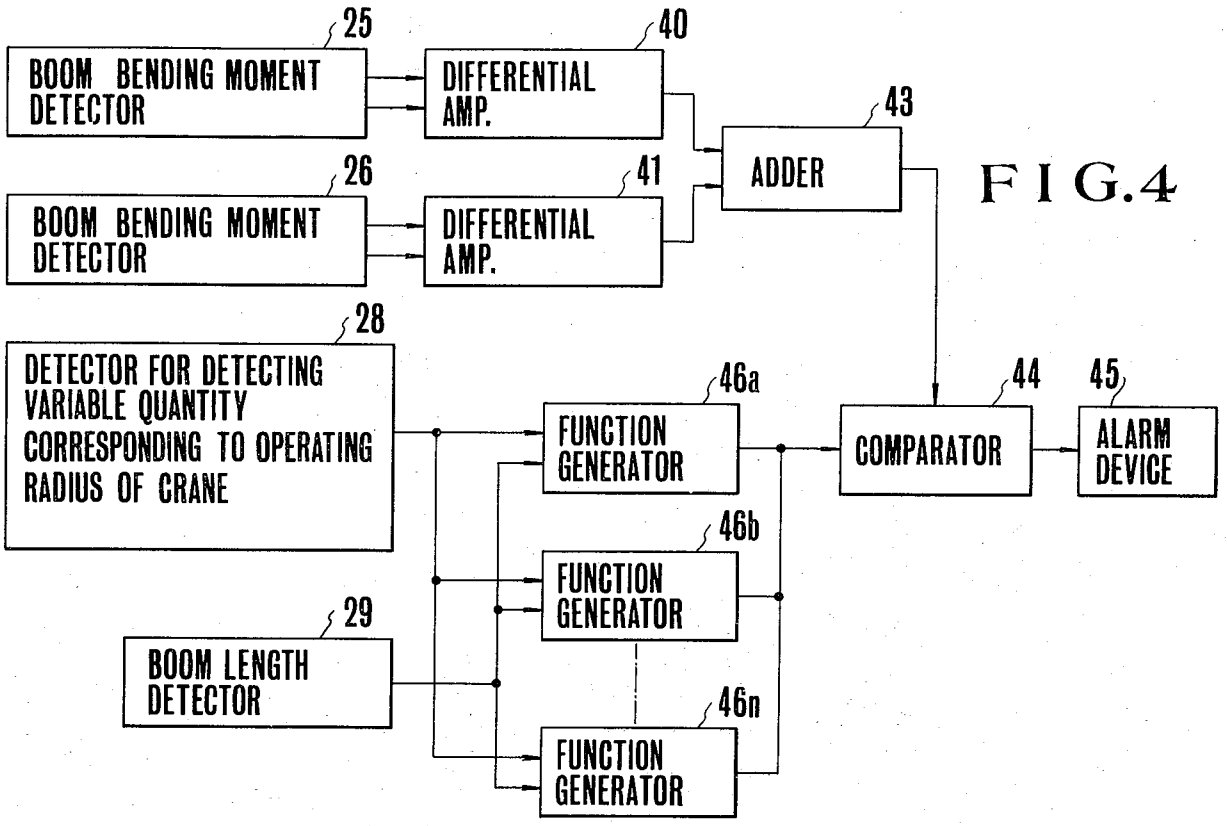
FIG. 4 is a block diagram showing the basic construction of the novel apparatus for detecting the overload of the crane embodying the invention.

The novel apparatus for preventing the overload of the crane utilizes various detectors described above which are connected as shown in FIG. 4 for detecting the overload condition. As shown in FIG. 4 the outputs from the boom bending moment detectors 25 and 26 are sent to differential amplifiers 40 and 41 respectively. However, the amplifier 40 may be an ordinary amplifier if a suitable reference voltage is selected for the circuit. The outputs of amplifiers 40 and 41 are applied to an adder 43 which provides the mean value of two outputs. As described above when detectors 25 and 26 are mounted on the lower surface of the boom 16 at points symmetrical to a plane containing the longitudinal axis of the boom and the mean value of the outputs of detectors 25 and 26 is obtained, even when the elevating force of the oil pressure cylinder 17 for the boom is not uniform, it is possible to eliminate the effect of such non-uniform elevating force, thus preventing decrease of the accuracy of detection. The output of adder 43 is applied to one input of a comparator 44 in which it is compared with a signal applied to the other input in a manner to be described later.

The output of the detector 28 for detecting the variable quantity corresponding to the operating radius of the crane and the output of the boom length detector 29 are applied to function generators 46*a* through 46*n* in such a manner that the output of the detector 28 is applied to one of the detectors which is selected by the output of the boom length detector 29. Thus, in response to the output of the detector 28, the selected function generator produces a signal representing a boom bending moment set value which is applied to the other input of the comparator 44 to be compared therein with the mean value signal from the adder 43. If the mean value signal is larger than the set value signal comparator 44 produces a signal which is used to operate an alarm device 45 or to stop the operation of the crane.

With this circuit arrangement the boom bending moment set value (or the reference value) is corrected in accordance with the inclination angle and the length of the boom corresponding to the operating radius of the crane and the corrected value is produced as the output of the function generators and compared with the mean value of the outputs of the boom bending moment detectors so that it is possible to accurately detect the overload. Thus, the operation of the overload detection apparatus is made stable because the mean value of the outputs of two boom bending moment detectors are used.

Figure 5:
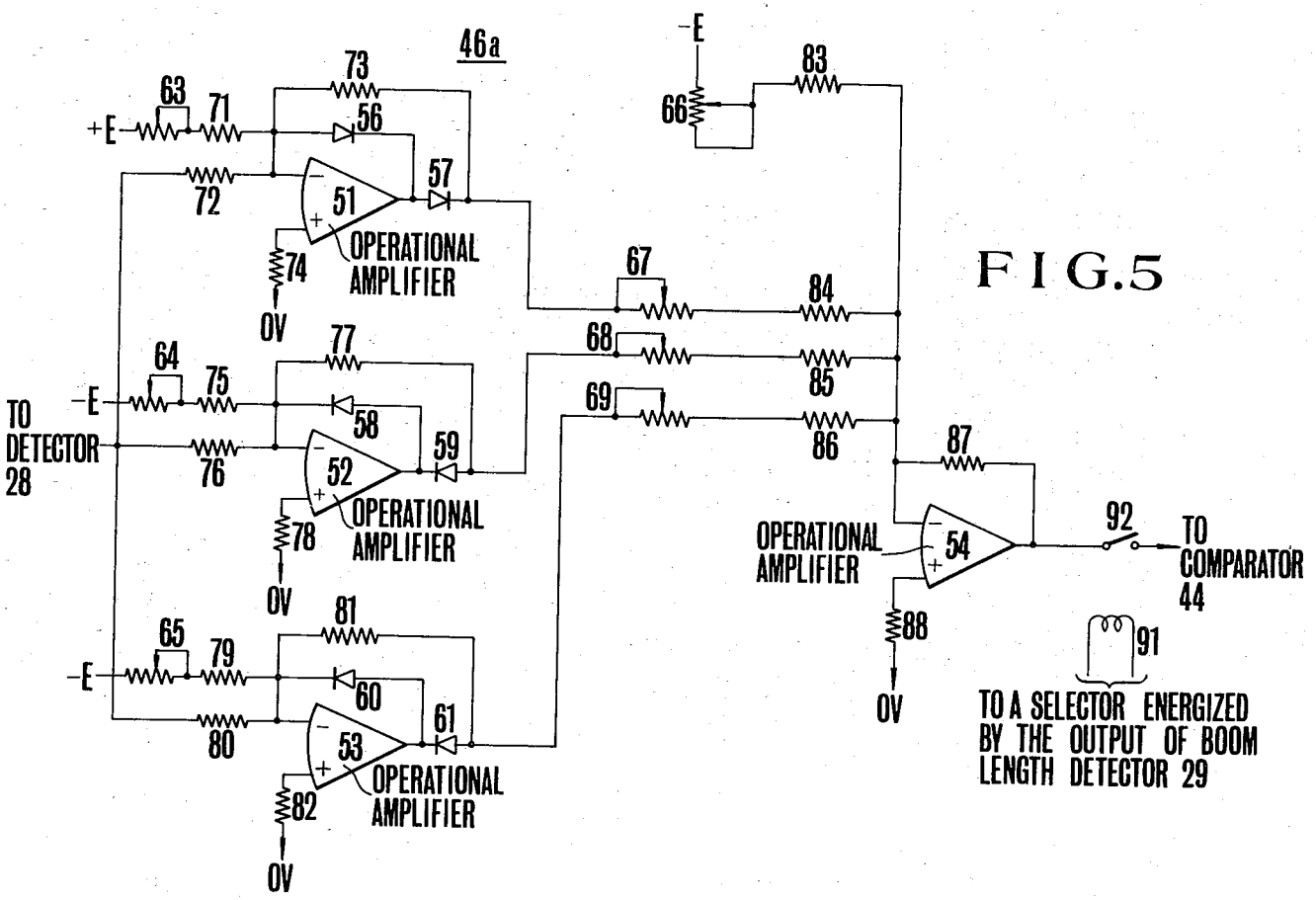
FIG. 5 is a circuit diagram showing one example of the function generator utilized in the circuit shown in FIG. 4.

FIG. 5 shows the connection diagram of one example of one of the function generators shown in FIG. 4, which comprises operational amplifiers 51 through 54, diodes 56 though 61, variable resistors 63 through 69, fixed resistors 71–88, and a relay 91 having a contact 92 connected between the output of the operational amplifier 54 and the comparator 44. The purpose of relay 91 is to determine that which one of the functions generated by the function generators 46*a* through 46*n* should be used depending upon the magnitude of the output of the boom length detector 29. The relay 91 is energized by the output of a selector, not shown, which selects one of the function generators in accordance with the output of the boom length detector 29, which may be digital or analogue.

Suppose now that function generator 46*a* is selected in accordance with the output of the boom length detector 29. As the output of the detector 28 which detects the variable quantity corresponding to the operating radius of the crane is impressed upon the operational amplifiers 51 through 53 of the selected function generator 46*a* the operational amplifiers 51, 52 and 53 produce outputs corresponding to the magnitude of the output of the detector 28 and the sum of the outputs of the operational amplifiers is applied to the amplifier 54. Thus, the function utilized at this time is determined in accordance with a reference bending moment corresponding to the output of the detector 28.

Figure 6:
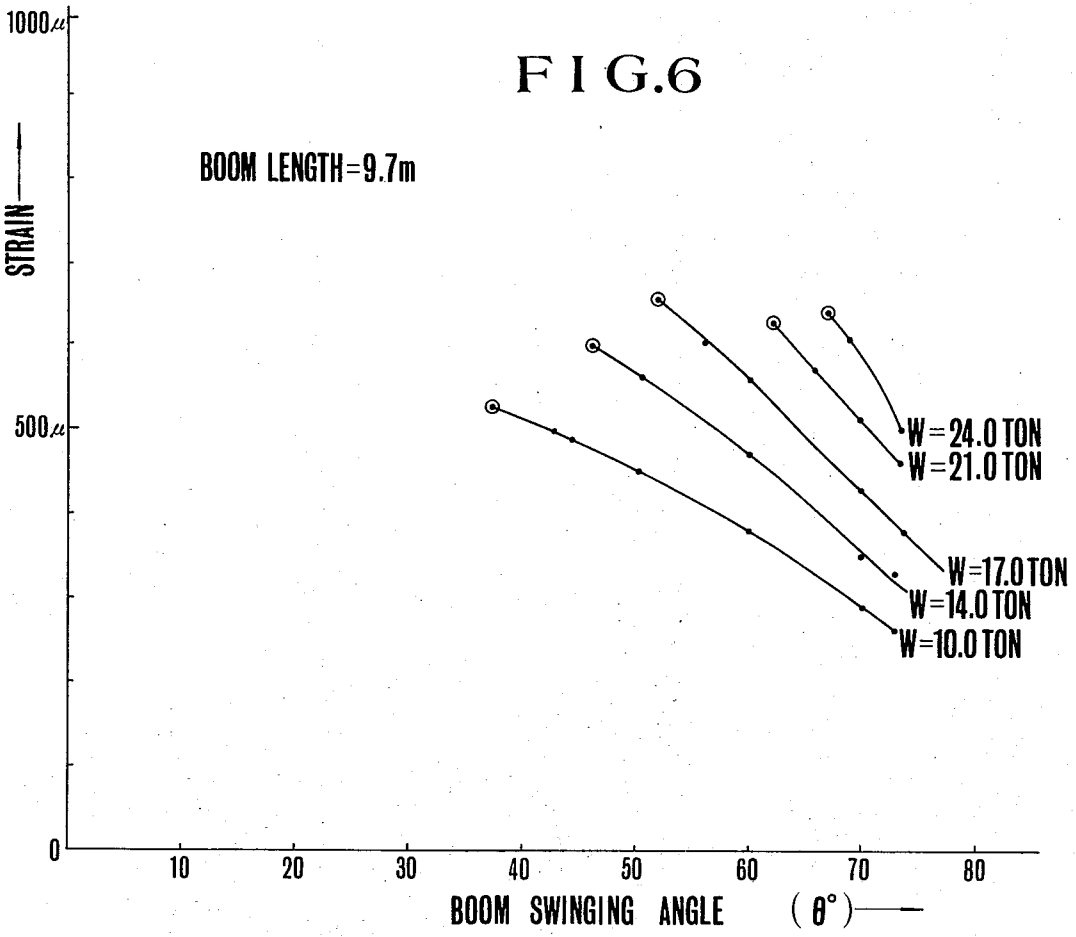
FIG. 6 is a graph showing the relationship between the strain and the boom angle.

FIG. 6 is a graph showing this relationship in which the abscissa represents the angle of swinging of the boom or turret and the ordinate strain. These curves were obtained for a boom length of 9.7m, and the weights of from 10.0 tons to 24.0 tons. The points indicated by • represent the values at a rated operating radius. The values of various component parts of the function generator 46*a* are determined to produce a function commensurate with the characteristic curves shown in FIG. 6. For example, when the strain is equal to 500$\mu$ the detector 50A produces an output of 5V and the values of the component elements of the function generator 46*a* are determined to process an input having a value of 5V.

In another of function generators 46*a* through 46*n*, the number of the operational amplifiers or the values of the component elements thereof are varied in accordance with other settings of the bending moment.

It should be understood that the invention is not limited to the particular embodiment described above and that many modifications may be made. For example, other than a truck crane the invention is also applicable to such other types of the crane as the tower type, post type, etc. so long as the crane is provided with a boom or an arm for supporting the load. The boom may have a fixed length.

It should also be understood that the number of the boom bending moment detectors may be one or more than two. Where only one boom bending moment detector is used, the accuracy of detection is lower than a case where two detectors are used, but such simplified arrangement can also be used practically with satisfactory results. Where only one detector is used, it is not necessary to use the adder or means for producing the mean value and the amplified output of the detector is applied directly to the comparator.

What is claimed is:

1. Apparatus for detecting overload of a crane having a boom for hanging loads, comprising a boom bending moment set value generator which is determined by a variable quantity corresponding to the operating radius of the crane, a pair of boom bending moment detectors mounted on said boom at two points spaced transversely symmetrical to a plane containing a longitudinal axis of said boom, means for producing a mean value of the outputs of said two detectors, a comparator for comparing the output of said boom bending moment set value generator with said mean value, and means operated by the output of said comparator which is produced when said mean value exceeds the output of said boom bending moment set value generator.

2. The apparatus according to claim 1 wherein said boom bending moment detector comprises a strain gauge.

3. The apparatus according to claim 1 wherein said means operated by the output of the comparator comprises an alarm device.

4. The apparatus according to claim 1 wherein said two strain gauges are connected to form two arms of a resistance bridge.

5. The apparatus according to claim 1 wherein said arm has a rectangular cross-sectional configuration and said boom bending moment detector is mounted on the lower surface of said boom.

6. The apparatus according to claim 1 wherein the angle of inclination of said boom with reference to the ground plane is varied by motive means and said boom bending moment detector is mounted on said boom at a point between the point at which said motive means is connected to said boom and the free end thereof.

7. The apparatus according to claim 1 wherein said boom bending moment set value generator comprises a plurality of function generators.

8. The apparatus according to claim 7 wherein said function generators are connected to receive and respond to an information signal concerning the angle of inclination of said boom.

9. The apparatus according to claim 7 wherein said crane is mounted on a turret to be swingable in the horizontal direction and said function generators are connected to receive and respond to an information signal concerning the swinging angle of said crane.

10. The apparatus according to claim 7 wherein said apparatus further comprises a boom length detector and means controlled by the output of said boom length detector and connected between said function generators and the comparator for modifying signals in accordance with boom lengths.

* * * * *